US009108113B1

(12) United States Patent
Baranov

(10) Patent No.: US 9,108,113 B1
(45) Date of Patent: Aug. 18, 2015

(54) FOLDING SLIDE

(71) Applicant: Nikolay Borisovich Baranov, Moscow (RU)

(72) Inventor: Nikolay Borisovich Baranov, Moscow (RU)

( * ) Notice: Subject to any disclaimer, the term of this patent is extended or adjusted under 35 U.S.C. 154(b) by 0 days.

(21) Appl. No.: 14/387,915

(22) PCT Filed: Oct. 1, 2013

(86) PCT No.: PCT/RU2013/000860

§ 371 (c)(1),
(2) Date: Sep. 25, 2014

(87) PCT Pub. No.: WO2014/074015

PCT Pub. Date: May 15, 2014

(30) Foreign Application Priority Data

Nov. 7, 2012 (RU) ..... 2012147042

(51) Int. Cl.
*A63G 21/04* (2006.01)
*A63B 9/00* (2006.01)

(52) U.S. Cl.
CPC ..... *A63G 21/04* (2013.01)

(58) Field of Classification Search
CPC ..... A63G 21/00; A63G 21/02; A63G 21/10; A63G 21/18; A63B 9/00; A63B 2008/12; A63B 2009/006; A63B 17/04
USPC ..... 472/116, 117, 128; 104/69, 70
See application file for complete search history.

(56) References Cited

U.S. PATENT DOCUMENTS 5,197,924 A * 3/1993 Gerrells ..... 472/116
6,634,953 B1 * 10/2003 Czintos ..... 472/90

FOREIGN PATENT DOCUMENTS

RU 2105587 2/1998
RU 2113265 6/1998

* cited by examiner

*Primary Examiner* — Kien Nguyen
(74) *Attorney, Agent, or Firm* — Aleksandr Smushkovich

(57) ABSTRACT

The proposed folding slide relates to amusements and is intended for sliding. It includes components stacked one above the other. Any lower component cooperates with the upper component disposed above. They are linked with a fastening member, guiding a sliding of the upper component upon the lower one in a direction within a predetermined distance. The friction coefficient for all component cooperation pairs is equal. The components' top and bottom surfaces are inclined at a predetermined angle to a base surface supporting the slide. The higher the cooperation pair is located, the lesser their inclination angle is. The second type folding slide includes releasable stoppers restricting the fastening member, preventing sliding of the upper component until the lower component completes its sliding. It can be supplemented with a mechanism for pulling the components into their initial position, safety steps with handrails, a lock against spontaneous rolling, a convenient user seat.

12 Claims, 2 Drawing Sheets

FOLDING SLIDE

CROSS-REFERENCE TO RELATED APPLICATIONS

This application is a U.S. national stage application of a PCT application PCT/RU2013/000860 filed on 1 Oct. 2013, whose disclosure is incorporated herein in its entirety by reference, which PCT application claims priority of a Russian Federation patent application RU2012147042 filed on 7 Nov. 2012.

FIELD OF INVENTION

The invention relates to the field of amusements and is intended for sliding, similar to sliding on a regular slide.

BACKGROUND OF THE INVENTION

The instant inventor is not aware of any devices or articles in the related art with a similar design.

BRIEF SUMMARY OF THE INVENTION

The present invention contemplates a folding slide of a first type, located on a base surface; said folding slide comprising:—a plurality of components disposed one above the other; each said component has an outer top surface and an outer bottom surface; said plurality of components includes a lowermost component immovable in relation to the base surface; the top surface of any lower said component is in a cooperative relation with the bottom surface of a corresponding said upper component disposed immediately above the lower component, such that the upper component and the lower component form a cooperation pair of components, and the upper component is capable of sliding upon the lower component of any said cooperation pair;—a plurality of fastening members; each said fastening member links the components of any said cooperation pair such that guiding the upper component of the cooperation pair in a predetermined direction within a predetermined distance during said sliding; wherein: a friction coefficient for all said cooperation pairs is equal; the top surface of the lower component and the bottom surface of the upper component of any said cooperation pair are inclined in relation to the base surface at a predetermined inclination angle; and the predetermined inclination angle of any said cooperation pair is greater than the predetermined inclination angle of the cooperation pair disposed above thereof.

The present invention also contemplates a folding slide of a second type, located on a base surface; said folding slide comprising:—a plurality of components disposed one above the other; each said component has an outer top surface and an outer bottom surface; said plurality of components includes a lowermost component immovable in relation to the base surface; the top surface of any lower said component is in a cooperative relation with the bottom surface of a corresponding upper said component disposed immediately above the lower component, such that the upper component and the lower component form a cooperation pair of components, and the upper component is capable of sliding upon the lower component of any said cooperation pair;—a plurality of fastening members; each said fastening member links the components of any said cooperation pair such that guiding the upper component of the cooperation pair in a predetermined direction within a predetermined distance during said sliding;—a plurality of releasable stoppers; each said stopper is built into a corresponding said component; wherein: each said stopper restricts movability of the corresponding fastening member of the upper component of the corresponding cooperation pair, until the sliding of the lower component of the corresponding cooperation pair is completed; thereafter the stopper is released, enabling movability of said corresponding fastening member, and thereby enabling the sliding of the upper component of said corresponding cooperation pair.

The folding slide of the above described types can be supplemented with:

(a) a mechanism providing for a gradual pulling of said components to each other in a direction opposite to said predetermined direction of the sliding.

(b) steps with handrails situated on a side opposite to said predetermined direction of the sliding to facilitate lifting a user on the folding slide and increase safety of using thereof.

(c) each said fastening member is supplemented with a lock preventing a spontaneous rolling of the components.

(d) said base surface is covered with a protective cover.

(e) said plurality of components includes a topmost component shaped for comfortable seating of a user of the folding slide.

(f) said plurality of components includes guides providing a connection between the components.

BRIEF DESCRIPTION OF DRAWINGS OF THE INVENTION

DETAIL DESCRIPTION OF PREFERRED EMBODIMENTS OF THE INVENTION

While the invention may be susceptible to embodiment in different forms, there will be described in detail herein, specific embodiments of the instant invention, with the understanding that the present disclosure is to be considered an exemplification of the principles of the invention, and is not intended to limit the invention to that as illustrated and described herein.

Figure 1:
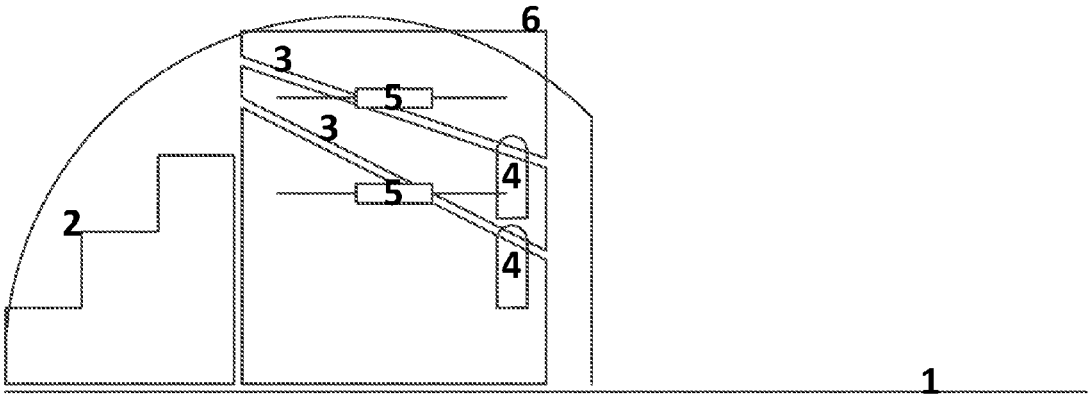
FIG. 1 shows a schematic view of the folding slide in an initial position, wherein the sliding starts, according to a preferred embodiment of the present invention.

The folding slide comprises at least two similar components 3, disposed one above the other (see FIG. 1).

Between each two adjacent components 3 there is a fastening member 5 that links the two adjacent components, which permits the movement of the upper component in relation to the lower component with a simultaneous decrease in height along an inclined plane over a limited distance (restricted by the fastening member 5) and in a predetermined direction.

Figure 2:
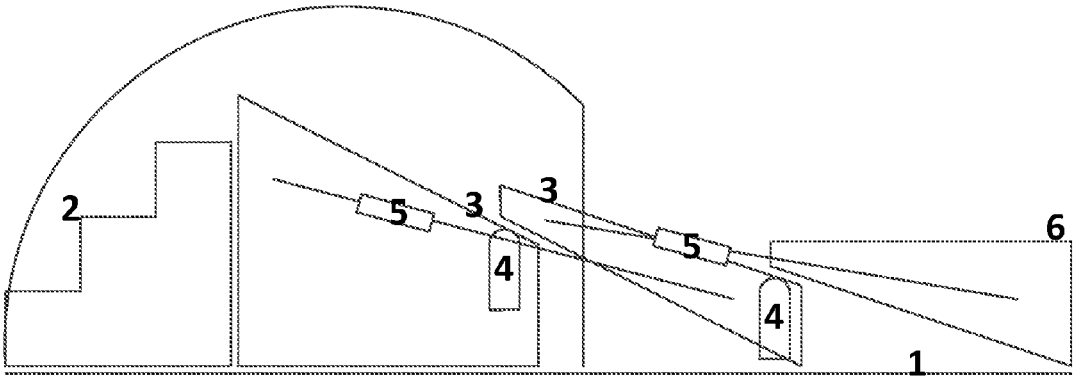
FIG. 2 shows a schematic view of the folding slide in a final position of sliding, wherein the sliding finishes, according to the preferred embodiment shown in FIG. 1.
Figure 3:
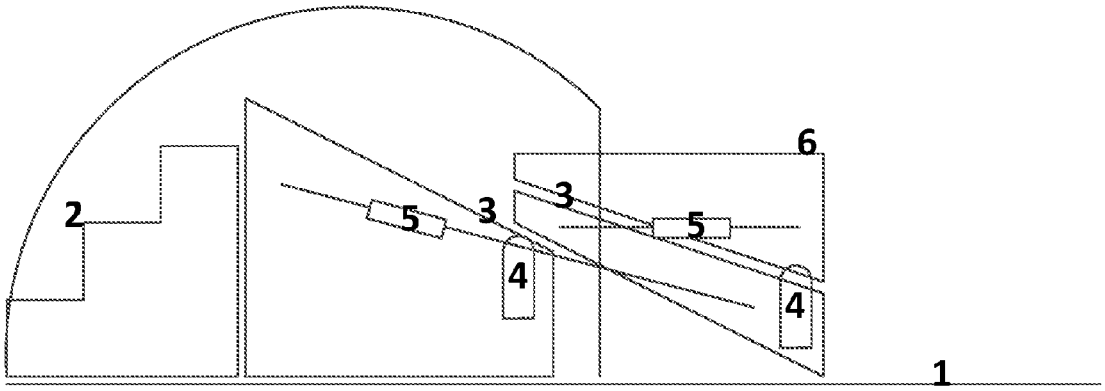
FIG. 3 shows a schematic view of the folding slide in an intermediate position of sliding, according to the preferred embodiment shown in FIG. 1.

Movement occurs at the point of a subsequent fastening member only once the movement at the point of the lower positioned fastening member has ceased (see FIG. 3). The result of the functioning of the folding slide of this design is a progressive movement of a person, located at the very top of the folding slide, downwards and outwards (i.e. sidewise) as on a conventional slide (see FIG. 2).

The principle of sliding from this folding slide does not involve movement of a person in a gutter, but consecutive progressive movement of the upper components of the slide with the person seating on the top component.

The inventive folding slide is located on a base surface 1 (e.g. floor), such that a first (lowermost) component is immovable in relation to the base surface 1. Under the action of gravitation force and taking into account the design of the folding slide, the primary motion must begin at the fastening member between the first component and a second component (disposed immediately above the first).

After completely shifting, the second component will rest on the base surface by one edge, and, by the other edge, it will rest on the lower front edge of the first component. Thus, the movement of the second component will be finished.

At this time, the fastening member between the second component and a third component (disposed immediately above the second) becomes movable, that causes the movement of the third component and, subsequently, all other components disposed above, due to both the action of gravity and inertia.

This cycle is repeated depending on the number of components involved and until the topmost component rests against the base surface by its front edge.

During the sliding process of the components with respect to each other, the overall height of the part of the folding slide moving at a specific moment, with a person located on the topmost component, will gradually decrease and the person will move in the space forward and downward as on a conventional slide within a gutter.

Structurally, the inventive folding slides can be divided into two types.

In the first type, the contact plane between the components has a maximum inclination angle to the base surface plane at the lowermost pair of components; and this angle gradually decreases at the planes of contact of the adjacent components disposed above the lowermost pair. Such design provides the correct order for starting of movement from the bottom-up due to the gravitation force. The fastening member 5 between the components 3 in this case should only ensure an equal friction coefficient and a predetermined restriction of the movement distance.

In the second type, the correct procedure for starting of movement from the bottom-up is provided by releasable stoppers 4 built into each component 3 and limiting the movability in the fastening members 5 of the components 3 placed above, until the completion of movement of the supporting (positioned below) component.

The design of the folding slide may be supplemented by the following elements (see FIG. 1 and FIG. 2):

1) A special covering of the base surface 1, along the longitudinal travel of the folding slide. It will ensure the safety of flooring in houses and apartments.

2) Steps 2 from the side opposite to the motion with handrails. This construction will facilitate the lifting on the slide and increase the safety of its use.

3) Guides (not shown) providing a connection between the components. This is necessary for preventing the sliding of the components from each other in any other direction except the predetermined one.

4) A lock-starter (not shown). It is an element that serves as a lock of spontaneous rolling of the folding slide.

5) Reassembly of the folding slide. The folding slide can be furnished with a special device (not shown), supplementing the fastening members 5 between the components 3 of the slide. It provides a gradual pulling of the components 3 to each other in the direction opposite to sliding. With a precise adjustment of effort of this device, it is possible to achieve the effect of self-assembly of the folding slide into the initial state after sliding.

6) A seat (not shown). This is the topmost component of the folding slide shaped to ensure a comfortable seating of people of various age groups.

The invention claimed is:

1. A folding slide located on a base surface; said folding slide comprising:

a plurality of components disposed one above the other; each said component has an outer top surface and an outer bottom surface; said plurality of components include a lowermost component immovable in relation to the base surface; the top surface of any lower component of said components is in a cooperative relation with the bottom surface of a corresponding said upper component disposed immediately above the lower component, such that the upper component and the lower component form a cooperation pair of components, and the upper component is capable of sliding upon the lower component of any said cooperation pair;

a plurality of fastening members; each said fastening member links the components of any said cooperation pair such that guiding the upper component of the cooperation pair in a predetermined direction within a predetermined distance during said sliding;

wherein:

a friction coefficient for all said cooperation pairs is equal; the top surface of the lower component and the bottom surface of the upper component of any said cooperation pair are inclined in relation to the base surface at a predetermined inclination angle; and the predetermined inclination angle of any said cooperation pair is greater than the predetermined inclination angle of the cooperation pair disposed above thereof.

2. The folding slide according to claim 1, wherein each said fastening member is supplemented with a mechanism providing for a gradual pulling of said components to each other in a direction opposite to said predetermined direction of the sliding.

3. The folding slide according to claim 1, further comprising steps with handrails situated on a side opposite to said predetermined direction of the sliding to facilitate lifting a user on the folding slide and increase safety of using thereof.

4. The folding slide according to claim 1, wherein each said fastening member is supplemented with a lock preventing a spontaneous rolling of the components.

5. The folding slide according to claim 1, wherein said base surface is covered with a protective cover.

6. The folding slide according to claim 1, wherein said plurality of components includes a topmost component shaped for comfortable seating of a user of the folding slide.

7. A folding slide located on a base surface; said folding slide comprising:

a plurality of components disposed one above the other; each said component has an outer top surface and an outer bottom surface; said plurality of components include a lowermost component immovable in relation to the base surface; the top surface of any lower component of said components is in a cooperative relation with the bottom surface of a corresponding upper said component disposed immediately above the lower component, such that the upper component and the lower component form a cooperation pair of components, and the upper component is capable of sliding upon the lower component of any said cooperation pair;

a plurality of fastening members; each said fastening member links the components of any said cooperation pair such that guiding the upper component of the cooperation pair in a predetermined direction within a predetermined distance during said sliding;

a plurality of releasable stoppers; each said stopper is built into a corresponding said component;

wherein:

each said stopper restricts movability of the corresponding fastening member of the upper component of the corresponding cooperation pair, until the sliding of the lower component of the corresponding cooperation pair is completed; thereafter the stopper is released, enabling movability of said corresponding fastening member, and thereby enabling the sliding of the upper component of said corresponding cooperation pair.

8. The folding slide according to claim 7, wherein each said fastening member is supplemented with a mechanism providing for a gradual pulling of said components to each other in a direction opposite to said predetermined direction of the sliding.

9. The folding slide according to claim 7, further comprising steps with handrails situated on a side opposite to said predetermined direction of the sliding to facilitate lifting a user on the folding slide and increase safety of using thereof.

10. The folding slide according to claim 7, wherein each said fastening member is supplemented with a lock preventing a spontaneous rolling of the components.

11. The folding slide according to claim 7, wherein said base surface is covered with a protective cover.

12. The folding slide according to claim 7, wherein said plurality of components includes a topmost component shaped for comfortable seating of a user of the folding slide.

* * * * *